US008067320B2

(12) United States Patent
Hisamoto

(10) Patent No.: US 8,067,320 B2
(45) Date of Patent: Nov. 29, 2011

(54) SPUNBONDED NONWOVEN FABRIC

(75) Inventor: Takashi Hisamoto, Chiba (JP)

(73) Assignee: Mitsui Chemicals, Inc., Minato-Ku, Tokyo (JP)

( * ) Notice: Subject to any disclaimer, the term of this patent is extended or adjusted under 35 U.S.C. 154(b) by 406 days.

(21) Appl. No.: 12/278,366

(22) PCT Filed: Jan. 29, 2007

(86) PCT No.: PCT/JP2007/051400

§ 371 (c)(1),
(2), (4) Date: Aug. 5, 2008

(87) PCT Pub. No.: WO2007/091444

PCT Pub. Date: Aug. 16, 2007

(65) Prior Publication Data

US 2009/0022956 A1 Jan. 22, 2009

(30) Foreign Application Priority Data

Feb. 6, 2006 (JP) ..... 2006-029011

(51) Int. Cl.
*D04H 3/16* (2006.01)

(52) U.S. Cl. ..... 442/401; 428/219

(58) Field of Classification Search ..... 442/401
See application file for complete search history.

(56) References Cited

U.S. PATENT DOCUMENTS

| | | | | |
|---|---|---|---|---|
| 6,548,432 | B1 * | 4/2003 | Hisada et al. | 442/327 |
| 7,255,763 | B2 * | 8/2007 | Kobayashi et al. | 156/167 |
| 7,829,487 | B2 | 11/2010 | Suzuki et al. | |
| 2003/0090020 | A1 | 5/2003 | Kobayashi et al. | |
| 2004/0067709 | A1 | 4/2004 | Kishine et al. | |
| 2007/0021022 | A1 | 1/2007 | Kishine et al. | |
| 2011/0022014 | A1 | 1/2011 | Suzuki et al. | |

FOREIGN PATENT DOCUMENTS

| | | | |
|---|---|---|---|
| CA | 1283764 | * | 5/1991 |
| JP | 63-288260 | A | 11/1988 |
| JP | 7-166415 | A | 6/1995 |
| JP | 10-280267 | A | 10/1998 |
| JP | 10-292256 | A | 11/1998 |
| JP | 11-972 | A | 1/1999 |
| JP | 2000-328420 | A | 11/2000 |
| JP | 2001-355172 | A | 12/2001 |
| JP | 2002-105832 | A | 4/2002 |
| JP | 2003-119658 | A | 4/2003 |
| KR | 2003-0071869 | A | 9/2003 |
| WO | WO 2004/048661 | A1 | 6/2004 |

OTHER PUBLICATIONS

PCT/ISA/210 , Apr. 4, 2007.
Office Action from Korean Patent Office issued in corresponding Korean Patent Application No. 10-2008-7021798 dated Oct. 27, 2010.
Japanese Official Action dated Jun. 28, 2011, issued by the Japanese Patent Office in corresponding Japanese Patent Application No. 2007-557789.
Office Action issued on Oct. 11, 2011, in corresponding Japanese Patent Application No. 2007-557789. not in English.

* cited by examiner

*Primary Examiner* — Norca L Torres Velazquez
(74) *Attorney, Agent, or Firm* — Buchanan Ingersoll & Rooney PC

(57) ABSTRACT

There is provided by the present invention a spunbonded nonwoven fabric which is formed from fibers comprising a propylene-based polymer and has MFR of 65 to 150 g/10 min and a fineness of 0.01 to 1.5 deniers, wherein the basis weight is in the range of 5 to 40 g/m$^2$ and the embossed area ratio is in the range of 6.5 to 25%.

4 Claims, No Drawings

SPUNBONDED NONWOVEN FABRIC

TECHNICAL FIELD

The present invention relates to a spunbonded nonwoven fabric which is formed from fibers comprising a propylene-based polymer and is useful for, for example, surface materials of sanitary materials, particularly backsheets, in a field requiring fluffing resistance, softness and strength and also requiring excellent productivity at the same time.

BACKGROUND ART

As outside surface materials of sanitary materials, typically backsheets of disposable diapers, sanitary napkins and the like, moisture-permeable single films have been used in the past, or air-through nonwoven fabrics or short fiber nonwoven fabrics such as point-bonded nonwoven fabrics have been used in combination with moisture-permeable films in the past. These conventional materials, however, have individual problems. For example, the moisture-permeable single films have a bad hand feeling though they are free from fluffing, the air-through nonwoven fabrics have problems in strength and fluffing resistance though they are soft, and the short fiber nonwoven fabrics have problems in softness and strength though they are excellent in economical efficiency and fluffing resistance.

With regard to use of the nonwoven fabrics for backsheets, it is disclosed in Japanese Patent Laid-Open Publication No. 972/1999 (patent document 1) to use a nonwoven fabric including a spunbonded nonwoven fabric together with a moisture-permeable film. In the existing circumstances, however, balance between fluffing resistance as a main property and other necessary properties such as strength and softness has not been studied yet similarly to the short fiber nonwoven fabrics. In the case where a nonwoven fabric is used as a surface material that is always exposed to friction, such as a backsheet, fluffing resistance is an important property. For example, when the nonwoven fabric is used for a disposable diaper, fluffing occurs and a fluff ball is formed, so that there is danger that an infant puts the fluff ball in the mouth, and besides, a problem of very bad appearance occurs. When the nonwoven fabric is used as a backsheet of a sanitary product, softness also becomes important. The reason is that there is a direct relation between softness and a feeling in use that is important for the user. Also in order to improve the touch for a person who wears the sanitary product, a helper, a nurse and the like, softness is necessary.

For example, softness of the nonwoven fabrics is described in Japanese Patent Laid-Open Publication No. 288260/1988 (patent document 2) or Japanese Patent Laid-Open Publication No. 280267/1998 (patent document 3). Further, with regard to strength of the spunbonded nonwoven fabrics, improvements have been made as disclosed in Japanese Patent Laid-Open Publication No. 292256/1998 (patent document 4). These improvements, however, are not intended for the surface materials such as backsheets, and studies including balance between fluffing resistance and other properties have not been made yet.

In the case where propylene-based polymer spunbonded nonwoven fabrics are provided for backsheet applications, examples of conventional methods to obtain softness include a method of carrying out a post processing step and a method of weakening compression bonding of a hot embossing roll. The former method, however, is inferior in productivity and economical efficiency, while in the latter method, fluffing resistance is lowered though softness is obtained. If basis weight is merely decreased in order to obtain both of fluffing resistance and softness, strength of the nonwoven fabric is lowered, and therefore, the degree of freedom in design of products such as diapers is restricted.

An attempt to obtain softness by decreasing fineness has been made, but the fiber lengths of fibers that have not been compression bonded are increased, and from this, lowering of fluffing resistance is presumed. Then, if severe compression-bonding temperature or contact pressure is applied in order to make the compression bond portion stronger, heat history of the non-compression bond portion is also increased, and hence, there occur problems such that the fibers lose softness, and breakage takes place in the compression bond portion, that is, an excess compression-bonding phenomenon such as pinhole takes place.

In order to decrease fineness, there are a method of increasing a spinning rate and a method of decreasing a discharge rate, and it is well known that in the case of polypropylene, the non-crystalline part or the loosely crystalline part, that is considered to participate in the compression bonding, is apt to be produced rather by decreasing a spinning rate. However, in order to produce a nonwoven fabric having a small fineness by this method, decrease of the discharge rate and decrease of the spinning rate become necessary, and in addition, lowering of the resin viscosity also becomes necessary to enhance fluidity. In such a method, therefore, there are problems such as deterioration of spinning property, lowering of productivity and lowering of physical properties.

By the way, in Japanese Patent Laid-Open Publication No. 105832/2002 (patent document 5), a spunbonded nonwoven fabric requiring no post processing, having excellent fluffing resistance and also having softness and strength is described. In the patent document 5, however, polypropylene having a relatively low melt flow rate is used as a raw material, and therefore, lowering of productivity attributable to occurrence of thread breakage is presumed. Moreover, it cannot be said that this spunbonded nonwoven fabric has sufficient softness, and therefore, further improvement is required.

Patent document 1: Japanese Patent Laid-Open Publication No. 972/1999

Patent document 2: Japanese Patent Laid-Open Publication No. 288260/1988

Patent document 3: Japanese Patent Laid-Open Publication No. 280267/1998

Patent document 4: Japanese Patent Laid-Open Publication No. 292256/1998

Patent document 5: Japanese Patent Laid-Open Publication No. 105832/2002

DISCLOSURE OF THE INVENTION

Problem to be Solved by the Invention

It is an object of the present invention to provide a spunbonded nonwoven fabric having excellent productivity without lowering fluffing resistance, softness and strength.

Means to Solve the Problem

The present inventors have studied the aforesaid problems, and they have found that the above object can be attained by using a propylene-based polymer and adjusting basis weight, MFR, fineness, embossed area ratio, etc. of a spunbonded nonwoven fabric to specific ranges.

That is to say, the present invention is a spunbonded nonwoven fabric which is formed from fibers comprising a propylene-based polymer and has MFR of 65 to 150 g/10 min and a fineness of 0.01 to 1.5 deniers, wherein the basis weight is in the range of 5 to 40 g/m$^2$ and the embossed area ratio is in the range of 6.5 to 25%.

The spunbonded nonwoven fabric preferably has a fluffing resistance of 1.0 to 2.0 points, a softness index, as expressed in terms of bending resistance/basis weight, of not more than 2.2 mm/20 mm/(g/m$^2$) and a tensile strength index, as expressed in terms of tensile strength/basis weight, of not less than 0.9 N/25 mm/(g/m$^2$).

The spunbonded nonwoven fabric is preferably produced by using a propylene-based polymer having MFR of 60 to 150 g/10 min.

The fibers comprising a propylene-based polymer are preferably formed in a draft ratio of not less than 1500.

EFFECT OF THE INVENTION

The spunbonded nonwoven fabric of the invention is a nonwoven fabric having excellent productivity, softness and high strength and hardly suffering fluffing, and is of industrially great value.

BEST MODE FOR CARRYING OUT THE INVENTION

The spunbonded nonwoven fabric of the invention is described in detail hereinafter.

The spunbonded nonwoven fabric for use in the invention is formed by melt spinning through a spunbonding method using a propylene-based polymer.

The propylene-based polymer is specifically a homopolymer of propylene or a copolymer of propylene and another α-olefin. Examples of the α-olefins to be copolymerized include α-olefins of 2 to 20 carbon atoms, such as ethylene, 1-butene, 1-pentene, 1-hexene, 1-octene, 1-decene, 3-methyl-1-butene, 3-methyl-1-pentene, 3-ethyl-1-pentene, 4-methyl-1-pentene and 4-methyl-1-hexene. Of these, ethylene and 1-butene are preferable, and ethylene is particularly preferable. Such α-olefins may be copolymerized singly or in combination of two or more kinds. When a copolymer of propylene and another α-olefin is used, the content of structural units derived from the α-olefin in the copolymer is preferably not more than 5.0% by mol.

In the present invention, to the propylene-based polymer may be added another polymer, a colorant, a heat stabilizer, a nucleating agent, etc. when needed, within limits not detrimental to the object of the invention.

The basis weight of the spunbonded nonwoven fabric of the invention is in the range of 5 to 40 g/m$^2$. When the spunbonded nonwoven fabric is used for a backsheet or the like by combining it with a moisture-permeable film, the basis weight of the spunbonded nonwoven fabric is in the range of preferably 5 g/m$^2$ to 30 g/m$^2$, more preferably 6 g/m$^2$ to 20 g/m$^2$. If the basis weight is less than the lower limit of the above range, strength of the nonwoven fabric is insufficient. If the basis weight exceeds the upper limit of the above range, the whole of the nonwoven fabric becomes thick to cause hard touch, so that such a value is undesirable.

The MFR of the spunbonded nonwoven fabric of the invention is in the range of 65 to 150 g/10 min, preferably 70 to 130 g/10 min. Provided that the MFR of the spunbonded nonwoven fabric is in this range, propylene-based polymers having different MFR may be mixed and used as raw materials. If the MFR of the spunbonded nonwoven fabric is less than the lower limit of the above range, productivity is lowered, and if the MFR thereof exceeds the upper limit of the above range, strength of the fiber itself becomes insufficient and satisfactory tensile strength is not obtained. In the present invention, MFR is a value measured under the conditions of a temperature of 230° C. and a load of 2.16 kg in accordance with JIS K7210-1999. This MFR value is a value measured after the spunbonded nonwoven fabric is formed.

The MFR of the propylene-based polymer that is a raw material of the nonwoven fabric of the invention is in the range of usually 60 to 150 g/10 min, preferably 70 to 120 g/10 min. By the use of a propylene-based polymer having MFR of such a range, a spunbonded nonwoven fabric having high productivity and excellent tensile strength is obtained. If the MFR of the propylene-based polymer is less than the lower limit of the above range, productivity is lowered, so that such MFR is undesirable. The value of MFR of this raw material is a value measured on the propylene-based polymer before production of a spunbonded nonwoven fabric.

The fineness of the spunbonded nonwoven fabric is in the range of 0.01 denier (referred to as "d" hereinafter) to 1.5 d, preferably 0.1 to 1.2 d. If the fineness of the spunbonded nonwoven fabric exceeds the upper limit of the above range, strength is lowered because of lowering of softness and uniformity (texture), so that such a fineness is undesirable. If the fineness thereof is less than the lower limit of the above range, stable spinning becomes difficult and productivity is lowered, so that such a fineness is undesirable.

The fiber that comprises a propylene-based polymer and forms the spunbonded nonwoven fabric has a draft ratio (ratio of area of nozzle hole diameter to area of fiber diameter) ((nozzle diameter [mm])$^2$)/((fiber diameter [mm])$^2$) of preferably not less than 1500, more preferably 1900 to 8200, still more preferably 2900 to 6300.

If the draft ratio of the fiber is less than the lower limit of the above range, strength of the fiber comprising a propylene-based polymer and further strength of the resulting spunbonded nonwoven fabric are insufficient. Hence, strength desired when the spunbonded nonwoven fabric is used for a backsheet of a sanitary product or the like is not satisfied. The upper limit of the draft ratio is not specifically restricted, but if the draft ratio exceeds 8200, stable spinning usually becomes difficult and productivity is lowered, so that such a draft ratio is undesirable.

The embossed area ratio of the spunbonded nonwoven fabric of the invention is in the range of 6.5 to 25%, preferably 7.0 to 21%. If the embossed area ratio of the spunbonded nonwoven fabric is less than the lower limit of the above range, fluffing resistance is deteriorated, and if it exceeds the upper limit of the above range, the touch becomes hard, so that such an embossed are ratio is undesirable.

The fluffing resistance of the spunbonded nonwoven fabric of the invention is in the range of 1.0 to 2.0 points, preferably 1.0 point. If a nonwoven fabric having a fluffing resistance of more than the upper limit of the above range is used as a backsheet of a paper diaper, fluff balls are liable to form because of friction with clothes or carpets, resulting in a problem of very bad appearance, and besides, there sometimes occurs danger that an infant puts the fluff ball in the mouth by mistake.

The "fluffing resistance" is an indication of difficulty in fluffing of a surface of a nonwoven fabric when contact of the nonwoven fabric with another member is repeated, and a nonwoven fabric having a smaller number is better. The fluffing resistance is a property determined by state of formation of entanglement, fiber length, fiber diameter, fiber strength, state of compression bonding, etc.

The softness index of the spunbonded nonwoven fabric of the invention is preferably not more than 2.2 mm/20 mm/(g/m$^2$), more preferably 1.0 to 2.0 mm/20 mm/(g/m$^2$). If the softness index of the spunbonded nonwoven fabric exceeds the upper limit of the above range, softness that is important sometimes becomes insufficient, because when the nonwoven fabric is used as a backsheet of a sanitary product, there is a direct relation between the softness index and a feeling in use that is important for the user, and the backsheet is a part which a person who wears the sanitary product, a helper, a nurse or the like touches.

The "softness index" of a nonwoven fabric is an indication indicating softness of a nonwoven fabric defined by bending resistance/basis weight of a nonwoven fabric, and is a value calculated from a bending resistance of a nonwoven fabric measured based on the A method "cantilever method" of 8.19.1 of JIS L1096-1999 and basis weight of the nonwoven fabric measured as above, and is an indication relating to an actual feeling in use of a nonwoven fabric.

The tensile strength index of the spunbonded nonwoven fabric of the invention is preferably not less than 0.9 N/25 mm/(g/m$^2$). If the tensile strength index of the spunbonded nonwoven fabric is less than 0.9 N/25 mm/(g/m$^2$), strength desired when the spunbonded nonwoven fabric is used for a backsheet of a sanitary product or the like is not satisfied occasionally.

The "tensile strength index" of a nonwoven fabric is an indication indicating strength of a nonwoven fabric defined by tensile strength/basis weight of a nonwoven fabric, and is a value calculated from a tensile strength of a nonwoven fabric measured based on the "cut strip method" of the "A method (strip method)" of (1) of 8.12.1 of JIS L1096-1999 and basis weight of the nonwoven fabric measured as above, and is an indication relating to an actual feeling in use of a nonwoven fabric.

A spunbonded nonwoven fabric satisfying the above properties defined by the present invention not only has a good feeling in use but also hardly suffers thread breakage or the like in the production of the spunbonded nonwoven fabric and has very excellent productivity.

The process for producing the spunbonded nonwoven fabric of the invention is not specifically restricted, but in order to obtain a spunbonded nonwoven fabric having such a small fiber diameter of not more than 1.5 d as in the invention, preferable is, for example, a production process in which a great number of continuous fibers spun from spinnerets are cooled with a cooling air flow and stretched with a stretching air flow newly introduced, as disclosed in Japanese Patent Laid-Open Publication No. 3853/1996, or a production process in which a cooling air flow is divided into two flows of different air flow velocities, and the cooling air flows are used as they are as stretching air flows, as disclosed in Japanese Patent Laid-Open Publication No. 302862/2002, and such a process has high productivity.

EXAMPLES

The propylene-based polymer spunbonded nonwoven fabric of the invention is described in more detail with reference to the following examples, but it should be construed that the invention is in no way limited to those examples.

Spunbonded nonwoven fabric production equipments used in the following examples and comparative examples are as follows.

Spunbonded Nonwoven Fabric Production Equipment (1)

Spunbonded nonwoven fabric production apparatus disclosed in Example 1 of Japanese Patent Laid-Open Publication No. 3853/1996, that is, spunbonded nonwoven fabric production equipment wherein a closed apparatus is constituted so that fibers spun from spinnerets may be slowly cooled at the throat part, then cooled with a cooling air flow in a cooling room and stretched with a stretching air flow introduced separately from the cooling air flow; the closed apparatus is equipped with a fiber dispersing device so that the fibers may be dispersed after stretched; the dispersed fibers are accumulated on a movable collecting device; and a device for partially carrying out compression bonding of the accumulated fiber aggregate by an embossing roll and a flat roll with controlling a pressure and a temperature is installed.

Spunbonded Nonwoven Fabric Production Equipment (2)

Spunbonded nonwoven fabric production equipment wherein an open apparatus is constituted so that fibers spun from spinnerets may be cooled with a cooling air flow supplied from one side and stretched with a stretching air flow introduced separately from the cooling air flow; the open apparatus is equipped with a fiber dispersing device so that the fibers may be dispersed after stretched; the dispersed fibers are accumulated on a movable collecting device; and a device for partially carrying out compression bonding of the accumulated fiber aggregate by an embossing roll and a flat roll with controlling a pressure and a temperature is installed.

Spunbonded Nonwoven Fabric Production Equipment (3)

Spunbonded nonwoven fabric production apparatus disclosed in Example 1 of Japanese Patent Laid-Open Publication No. 302862/2002, that is, spunbonded nonwoven fabric production equipment wherein a closed apparatus has upper and lower two cooling air flow supply opening parts for introducing cooling air flows into a cooling room and is constituted so that the cooling air flows may function also as stretching air flows; the closed apparatus is equipped with a fiber dispersing device so that the fibers may be dispersed after stretched; the dispersed fibers are accumulated on a movable collecting device; and a device for partially carrying out compression bonding of the accumulated fiber aggregate by an embossing roll and a flat roll with controlling a pressure and a temperature is installed.

Measuring methods used in the following examples and comparative examples are as follows.

(1) MFR (Melt Flow Rate [g/10 min (230° C.)])

MFR was measured in accordance with b "Method for measuring time in which piston moves a given distance" of the B method of Paragraph 7 of JIS K7210-1999 except for the following matters.

[1] From each of the prepared spunbonded nonwoven fabric samples composed of a propylene-based polymer, 5 tests specimens each weighing 5 g were picked. The picking places in the MD direction were arbitrarily selected, and those in the CD direction were 5 places present on a straight line at regular intervals, excluding both ends 20 cm of the nonwoven fabric sample.

[2] The test specimen was packed into a cylinder having a length of 160 mm and an inner diameter of 9.550 mm with tweezers.

[3] Using an automatic extrusion plastometer (manufactured by Tester Sangyo Co., Ltd., TP-406 model), MFR was measured under the conditions of a test temperature of 230° C., a load of 2.16 kg and a measuring distance of 6 mm.

[4] The 5 test specimens of each nonwoven fabric sample were separately measured on MFR, then a mean value was calculated, and a value obtained by rounding off the number of the mean value to the units digit was regarded as MFR of each spunbonded nonwoven fabric.

(2) Fineness (Denier, d, Number of Grams of Fiber Based on 900 m)

1 d=1 g/fiber length 9000 m

[1] From each of the prepared spunbonded nonwoven fabric samples, 10 test specimens each having a size of 10 mm×10 mm were picked. The picking places in the MD direction were arbitrarily selected, and those in the CD direction were 10 places present on a straight line at regular intervals, excluding both ends 20 cm of the nonwoven fabric sample.

[2] Using a Nikon ECLIPSE E400 microscope of 20 magnifications, the diameter of the fiber was read out up to one decimal place in a unit of μm. Diameters at arbitrary 20 places were measured for each test specimen. These measurements were carried out on each of the prepared 10 test specimens (diameter measuring points: 200 in all). From the results of diameter measurements, the number of grams of the fiber based on 9000 m at every measuring point was calculated. In this calculation, the density of polypropylene was set to 0.91 $g/cm^3$.

[3] The number of grams of the fiber based on 9000 m at each of 200 measuring points was individually converted, then a mean value of the converted values was determined, and a value obtained by rounding off the number of the mean value to one decimal place was regarded as a fineness of each nonwoven fabric sample.

(3) Draft Ratio

A mean value of the diameter measurement results at the total 200 measuring points determined in the above fineness measurement was calculated, and a value obtained by rounding off the number of the mean value to one decimal place was regarded as a fiber diameter (unit: μm).

From the nozzle diameter (unit: mm) used in each spunbond nonwoven fabric production equipment and the resulting fiber diameter, a draft ratio was determined by the following formula, and a value obtained by rounding off the resulting number to the hundreds digit was regarded as a draft ratio of each spunbonded nonwoven fabric sample.

$$\text{Draft ratio}=(\text{nozzle diameter [mm]})^2/(\text{fiber diameter [mm]})^2$$

(4) Basis Weight [$g/m^2$]

Basis weight was measured in accordance with "Mass per unit area under standard condition" of Paragraph 6.4.2 of JIS L1096-1990.

[1] From each of the prepared spunbonded nonwoven fabric samples, circular test specimens each having a size of 100 $cm^2$ were picked. The picking places in the MD direction were arbitrarily selected, and those in the CD direction were 20 places present on a straight line at regular intervals, excluding both ends 20 cm of the nonwoven fabric sample.

[2] Using an electronic even balance (manufactured by Shimadzu Corporation, EB-330 model), mass (g) of each test specimen picked was measured. Then, a mean value of the mass values of the test specimens was determined. From the mean value, mass (g) based on 1 $m^2$ was calculated, and a value obtained by rounding off the resulting number to one decimal place was regarded as basis weight of each nonwoven fabric sample.

(5) Fluffing Resistance (Point(s))

[1] From each of the prepared spunbonded nonwoven fabric samples, 40 test specimens each having a size of 300 mm (MD)×25 mm (CD) were picked. The picking places in the MD direction were arbitrary 2 places (for evaluation of embossing roll side surface (front surface) and for evaluation of flat roll side surface (back surface)), and those in the CD direction were 20 places present on a straight line at regular intervals, excluding both ends 20 cm of the nonwoven fabric sample (total places: 40 in all).

[2] Using a device "Friction tester II type (type in the method of the Japan Society for the Promotion of Science)" described in b of 5.1 of 5 of JIS-L0849-2004, evaluation was carried out. Specifically, RT-100 model manufactured by Daiei Kagaku Seiki Mfg. Co., Ltd. was used as the device. The load of a frictional element was 200 g, and a packaging adhesive tape (fabric) No. 314 (available from Rinrei Tape Co., Ltd.) was used and set so that the adhesive surface of the adhesive tape and the measuring surface of the test specimen could be rubbed with each other. In this operation, in order to prevent deviation of the test specimen during the measurement, a sand paper "No. 400" was mounted on a mount of the device in such a manner that the sand surface faced upward, and the test specimen was placed on the sand surface in such a manner that the evaluation surface faced upward. Thus, the test specimen was mounted on the mount of the measuring device.

[3] After the test specimen was mounted, the measuring surface of the test specimen and the non-adhesive surface of the adhesive tape were rubbed with each other by moving them 50 reciprocations.

[4] The rubbed surface of the test specimen was observed, and regarding fluffing resistance, the test specimen was scored and evaluated by the following criteria.

1 point: There is no fluffing.

2 points: Fluffing occurs to such an extent that a small fluff ball begins to form at one place.

3 points: A conspicuous fluff ball begins to form, and plural small fluff balls are found.

4 points: A large conspicuous fluff ball is found, and fibers begin to lift at plural places.

5 points: Fibers are markedly torn off so that the test specimen may be thinned.

6 points: Fibers are torn off so that the test specimen may be broken.

[5] Each of the test specimens was subjected to the above operations [1] to [4]. Regarding the test specimen for front surface evaluation, the back surface was rubbed and evaluated, and regarding the test specimen for back surface evaluation, the back surface was rubbed and evaluated.

[6] A mean value of the 40 test specimens (front: 20, back: 20) was calculated, and a value obtained by rounding off the number of the mean value to one decimal place was regarded as a fluffing resistance of each nonwoven fabric sample.

(6) Softness Index

The softness index was measured in accordance with the "A method (45° cantilever method)" of 8.19.1 of JIS L1096-1999.

[1] From each of the prepared spunbonded nonwoven fabric samples, 40 rectangular test specimens each having a length of 150 mm and a width of 20 mm (20 specimens that are longer in the MD direction and 20 specimens that are longer in the CD direction) were picked. The picking places in the MD direction of each nonwoven fabric sample were arbitrary 2 places (picking place for specimen that is longer in the CD direction and picking place for specimen that is longer in the MD direction), and those in the CD direction were 20 places present on a straight line at regular intervals, excluding both ends 20 cm of the nonwoven fabric sample (total of picking places: 40).

[2] Each of the front and the back surfaces of each test specimen picked was measured (unit: mm), and the number up to the integer digit was read out. Then, a mean value was calculated, and the number of the mean value was rounded off to one decimal place.

[3] The above measurement was carried out on each of the 40 test specimens, then a mean value was calculated, and a value obtained by rounding off the number of the mean value to one decimal place was regarded as a bending resistance [mm/20 mm] of each nonwoven fabric sample. Then, the softness index was calculated from the following formula.

Softness index=mean value of bending resistance [mm/20 mm]/basis weight [g/m$^2$]

(7) Tensile Strength, Tensile Strength Index

Measurement was carried out in accordance with the "cut strip method" of the "A method (strip method)" of (1) of 8.12.1 of JIS L1096-1999 except for the following matters.

[1] From each of the prepared spunbonded nonwoven fabric samples, 40 test specimens each having a length of 200 mm and a width of 25 mm (20 specimens that are longer in the MD direction and 20 specimens that are longer in the CD direction) were picked in the same manner as in the above (5).

[2] Using a constant rate stretching type tensile tester (Instron 5564 model), to each test specimen was applied a load in the lengthwise direction of the test specimen under the conditions of a chuck-to-chuck distance of 100 mm and a pulling rate of 100 mm/min until the test specimen was broken, and the maximum load [N/25 mm] was measured.

[3] This measurement was carried out on each of the 40 test specimens, a mean value of the maximum load values was calculated, and a value obtained by rounding off the number of the mean value to one decimal place was regarded as a tensile strength [N/25 mm] of each nonwoven fabric sample.

[4] The tensile strength index was calculated from the following formula, and a value obtained by rounding off the resulting number to one decimal place was regarded as a tensile strength index of each nonwoven fabric sample.

Tensile strength index=tensile strength [*N*/25 mm]/basis weight [g/m$^2$]

(8) Productivity

Productivity was evaluated by thread breakage of a fiber in the production of a spunbonded nonwoven fabric. After the production conditions for each spunbonded nonwoven fabric sample were adjusted, each nonwoven fabric sample was continuously produced for 10 minutes, and the state of the fiber in this production was observed.

AA: There is no thread breakage.

BB: There is thread breakage.

Example 1

As a spunbonded nonwoven fabric raw material, polypropylene (polypropylene homopolymer, MFR (measured at a temperature of 230° C. under a load of 2.16 kg in accordance with JIS K7210-1999): 65 g/10 min) was used. Using the spunbonded nonwoven fabric production equipment (1), a web was obtained with controlling the dispersing device under the conditions of a nozzle diameter of 0.60 mm, a single hole discharge rate of 0.35 g/min, a resin temperature of 225° C., a cooling air flow velocity of 1.8 m/s, a cooling temperature of 20° C. and a stretching air flow rate of 3000 m$^3$/hr/m. The web was passed between an embossing roll (embossing pattern shape: rhombus, embossing pattern size: 0.67 mm×0.67 mm, pitch: 1.47 mm×1.47 mm, embossed area ratio: 21%, staggered arrangement, embossing pattern inclination: 45 degrees) and a flat roll to perform hot embossing with controlling a pressure and a temperature. Thus, a spunbonded nonwoven fabric having a fiber diameter of 1.2 d, a draft ratio of 1900, nonwoven fabric-constituting polypropylene fiber MFR of 70 g/10 min and basis weight of 17 g/m$^2$ was obtained.

Then, fluffing resistance, softness and tensile strength of the spunbonded nonwoven fabric were measured.

The results are set forth in Table 1.

Example 2

A spunbonded nonwoven fabric having basis weight of 15 g/m$^2$ was obtained in the same manner as in Example 1, except that the speed of the movable collecting device was controlled.

Properties of the spunbonded nonwoven fabric were measured and evaluated in the same manner as in Example 1.

The results are set forth in Table 1.

Example 3

A spunbonded nonwoven fabric having a fiber diameter of 1.2 d, a draft ratio of 1900, nonwoven fabric-constituting polypropylene fiber MFR of 130 g/10 min and basis weight of 17 g/m$^2$ was obtained by using polypropylene having MFR of 120 g/10 min as raw material polypropylene, changing the resin temperature to 215° C., changing the cooling air flow velocity to 1.6 m/s, and changing the stretching air flow rate to 2600 m$^3$/hr/m in Example 1.

Properties of the spunbonded nonwoven fabric were measured and evaluated in the same manner as in Example 1.

The results are set forth in Table 1.

Example 4

A spunbonded nonwoven fabric having a fiber diameter of 0.8 d, a draft ratio of 2900, nonwoven fabric-constituting polypropylene fiber MFR of 75 g/10 min and basis weight of 17 g/m$^2$ was obtained by using polypropylene having MFR of 70 g/10 min as raw material polypropylene, changing the resin temperature to 235° C., changing the cooling air flow velocity to 1.6 m/s, and changing the stretching air flow rate to 4500 m$^3$/hr/m in Example 1.

Properties of the spunbonded nonwoven fabric were measured and evaluated in the same manner as in Example 1.

The results are set forth in Table 1.

Example 5

A spunbonded nonwoven fabric having a fiber diameter of 0.5 d, a draft ratio of 4600, nonwoven fabric-constituting polypropylene fiber MFR of 75 g/10 min and basis weight of 17 g/m$^2$ was obtained by using polypropylene having MFR of 70 g/10 min as raw material polypropylene, changing the resin temperature to 245° C., changing the cooling air flow velocity to 1.6 m/s, and changing the stretching air flow rate to 6700 m$^3$/hr/m in Example 1.

Properties of the spunbonded nonwoven fabric were measured and evaluated in the same manner as in Example 1.

The results are set forth in Table 1.

Example 6

A spunbonded nonwoven fabric having a fiber diameter of 0.5 d, a draft ratio of 4600, nonwoven fabric-constituting polypropylene fiber MFR of 110 g/10 min and basis weight of 17 g/m$^2$ was obtained by using polypropylene having MFR of 100 g/10 min as raw material polypropylene, changing the resin temperature to 235° C., changing the cooling air flow velocity to 1.6 m/s, and changing the stretching air flow rate to 6700 m$^3$/hr/m in Example 1.

Properties of the spunbonded nonwoven fabric were measured and evaluated in the same manner as in Example 1.

The results are set forth in Table 1.

Comparative Example 1

A spunbonded nonwoven fabric having a fiber diameter of 1.2 d, a draft ratio of 1900, nonwoven fabric-constituting polypropylene fiber MFR of 50 g/10 min and basis weight of 17 g/m$^2$ was obtained in the same manner as in Example 1, except that polypropylene having MFR of 40 g/10 min was used as raw material polypropylene and the resin temperature was changed to 235° C.

Properties of the spunbonded nonwoven fabric were measured and evaluated in the same manner as in Example 1.

The results are set forth in Table 1.

Comparative Example 2

A spunbonded nonwoven fabric having a fiber diameter of 1.8 d, a draft ratio of 1300, nonwoven fabric-constituting polypropylene fiber MFR of 70 g/10 min and basis weight of 17 g/m$^2$ was obtained by changing the resin temperature to 210° C., changing the cooling air flow velocity to 1.6 m/s, and changing the stretching air flow rate to 2000 m$^3$/hr/m in Example 1.

Properties of the spunbonded nonwoven fabric were measured and evaluated in the same manner as in Example 1.

The results are set forth in Table 1.

Comparative Example 3

A spunbonded nonwoven fabric having a fiber diameter of 1.2 d, a draft ratio of 1900, nonwoven fabric-constituting polypropylene fiber MFR of 70 g/10 min and basis weight of 17 g/m$^2$ was obtained in the same manner as in Example 1, except that an embossing roll (embossing pattern shape: circle, embossing pattern size: diameter 0.43 mm, pitch: 11.1 mm×2.1 mm, staggered arrangement) having an embossed area ratio of 6.3% was used.

Properties of the spunbonded nonwoven fabric were measured and evaluated in the same manner as in Example 1.

The results are set forth in Table 1.

Example 7

As a spunbonded nonwoven fabric raw material, polypropylene (polypropylene homopolymer, MFR (measured at a temperature of 230° C. under a load of 2.16 kg in accordance with JIS K7210-1999): 65 g/10 min) was used. Using the spunbonded nonwoven fabric production equipment (2), a web was obtained with controlling the dispersing device under the conditions of a nozzle diameter of 0.60 mm, a single hole discharge rate of 0.35 g/min, a resin temperature of 225° C., a cooling air flow velocity of 2.0 m/s, a cooling temperature of 20° C. and a stretching air gun pressure of 5.0 kgf/cm$^2$. The web was passed between an embossing roll (embossing pattern shape: rhombus, embossing pattern size: 0.45 mm×0.45 mm, pitch: 1.7 mm×1.7 mm, embossed area ratio: 7.0%, staggered arrangement, embossing pattern inclination: 45 degrees) and a flat roll to perform hot embossing. Thus, a spunbonded nonwoven fabric having a fiber diameter of 1.2 d, a draft ratio of 1900, nonwoven fabric-constituting polypropylene fiber MFR of 75 g/10 min and basis weight of 17 g/m$^2$ was obtained.

Properties of the spunbonded nonwoven fabric were measured and evaluated in the same manner as in Example 1.

The results are set forth in Table 2.

Example 8

A spunbonded nonwoven fabric having basis weight of 15 g/m$^2$ was obtained in the same manner as in Example 7, except that the speed of the movable collecting device was controlled.

Properties of the spunbonded nonwoven fabric were measured and evaluated in the same manner as in Example 1.

The results are set forth in Table 2.

Example 9

A spunbonded nonwoven fabric having a fiber diameter of 1.2 d, a draft ratio of 1900, nonwoven fabric-constituting polypropylene fiber MFR of 130 g/10 min and basis weight of 17 g/m$^2$ was obtained in the same manner as in Example 7, except that polypropylene having MFR of 120 g/10 min was used as raw material polypropylene, the resin temperature was changed to 215° C., the cooling air flow velocity was changed to 1.8 m/s, and the stretching air gun pressure was changed to 4.0 kgf/cm$^2$.

Properties of the spunbonded nonwoven fabric were measured and evaluated in the same manner as in Example 1.

The results are set forth in Table 2.

Example 10

A spunbonded nonwoven fabric having a fiber diameter of 0.8 d, a draft ratio of 2900, nonwoven fabric-constituting polypropylene fiber MFR of 74 g/10 min and basis weight of 17 g/m$^2$ was obtained by using polypropylene having MFR of 70 g/10 min as raw material polypropylene, changing the resin temperature to 235° C., changing the cooling air flow velocity to 1.8 m/s, and changing the stretching air gun pressure to 6.0 kgf/cm$^2$ in Example 7.

Properties of the spunbonded nonwoven fabric were measured and evaluated in the same manner as in Example 1.

The results are set forth in Table 2.

Example 11

A spunbonded nonwoven fabric having a fiber diameter of 0.5 d, a draft ratio of 4600, nonwoven fabric-constituting polypropylene fiber MFR of 74 g/10 min and basis weight of 17 g/m$^2$ was obtained by using polypropylene having MFR of 70 g/10 min as raw material polypropylene, changing the resin temperature to 245° C., changing the cooling air flow velocity to 1.8 m/s, and changing the stretching air gun pressure to 7.0 kgf/cm$^2$ in Example 7.

Properties of the spunbonded nonwoven fabric were measured and evaluated in the same manner as in Example 1.

The results are set forth in Table 2.

Example 12

A spunbonded nonwoven fabric having a fiber diameter of 0.5 d, a draft ratio of 4600, nonwoven fabric-constituting polypropylene fiber MFR of 116 g/10 min and basis weight of 17 g/m$^2$ was obtained by using polypropylene having MFR of 100 g/10 min as raw material polypropylene, changing the resin temperature to 235° C., changing the cooling air flow velocity to 1.6 m/s, and changing the stretching air gun pressure to 7.0 kgf/cm$^2$ in Example 7.

Properties of the spunbonded nonwoven fabric were measured and evaluated in the same manner as in Example 1.

The results are set forth in Table 2.

Comparative Example 4

A spunbonded nonwoven fabric having a fiber diameter of 1.2 d, a draft ratio of 1900, nonwoven fabric-constituting polypropylene fiber MFR of 51 g/10 min and basis weight of 17 g/m$^2$ was obtained in the same manner as in Example 7, except that polypropylene having MFR of 40 g/10 min was used as raw material polypropylene and the resin temperature was changed to 235° C.

Properties of the spunbonded nonwoven fabric were measured and evaluated in the same manner as in Example 1.

The results are set forth in Table 2.

Comparative Example 5

A spunbonded nonwoven fabric having a fiber diameter of 1.8 d, a draft ratio of 1300, nonwoven fabric-constituting polypropylene fiber MFR of 70 g/10 min and basis weight of 17 g/m$^2$ was obtained in the same manner as in Example 7, except that the resin temperature was changed to 210° C., the cooling air flow velocity was changed to 1.8 m/s, and the stretching air gun pressure was changed to 3.0 kgf/cm$^2$.

Properties of the spunbonded nonwoven fabric were measured and evaluated in the same manner as in Example 1.

The results are set forth in Table 2.

Comparative Example 6

A spunbonded nonwoven fabric having a fiber diameter of 1.2 d, a draft ratio of 1900, nonwoven fabric-constituting polypropylene fiber MFR of 70 g/10 min and basis weight of 17 g/m$^2$ was obtained in the same manner as in Example 7, except that an embossing roll (embossing pattern shape: circle, embossing pattern size: diameter 0.43 mm, pitch: 11.1 mm×2.1 mm, staggered arrangement) having an embossed area ratio of 6.3% was used.

Properties of the spunbonded nonwoven fabric were measured and evaluated in the same manner as in Example 1.

The results are set forth in Table 2.

Example 13

As a spunbonded nonwoven fabric raw material, polypropylene (polypropylene homopolymer, MFR (measured at a temperature of 230° C. under a load of 2.16 kg in accordance with JIS K7210-1999): 65 g/10 min) was used. Using the spunbonded nonwoven fabric production equipment (3), a web was obtained with controlling the dispersing device under the conditions of a nozzle diameter of 0.60 mm, a single hole discharge rate of 0.35 g/min, a resin temperature of 225° C., an upper cooling air flow velocity of 0.4 m/s, a cooling temperature of 20° C., an upper cooling air flow velocity of 1.4 m/s and a cooling temperature of 20° C. The web was passed between an embossing roll (embossing pattern shape: rhombus, embossing pattern size: 0.88 mm×0.88 mm, pitch: 1.52 mm×1.32 mm, embossed area ratio: 18%, staggered arrangement, embossing pattern inclination: 30 degrees and 150 degrees (alternately arranged every row in the CD direction)) and a flat roll to perform hot embossing. Thus, a spunbonded nonwoven fabric having a fiber diameter of 1.2 d, a draft ratio of 1900, nonwoven fabric-constituting polypropylene fiber MFR of 70 g/10 min and basis weight of 17 g/m$^2$ was obtained.

Properties of the spunbonded nonwoven fabric were measured and evaluated in the same manner as in Example 1.

The results are set forth in Table 3.

Example 14

A spunbonded nonwoven fabric having basis weight of 15 g/m$^2$ was obtained in the same manner as in Example 13, except that the speed of the movable collecting device was controlled.

Properties of the spunbonded nonwoven fabric were measured and evaluated in the same manner as in Example 1.

The results are set forth in Table 3.

Example 15

A spunbonded nonwoven fabric having a fiber diameter of 1.2 d, a draft ratio of 1900, nonwoven fabric-constituting polypropylene fiber MFR of 130 g/10 min and basis weight of 17 g/m$^2$ was obtained by using polypropylene having MFR of 120 g/10 min as raw material polypropylene, changing the resin temperature to 215° C., changing the upper cooling air flow velocity to 0.3 m/s, and changing the lower cooling air flow velocity to 1.2 m/s in Example 13.

Properties of the spunbonded nonwoven fabric were measured and evaluated in the same manner as in Example 1.

The results are set forth in Table 3.

Example 16

A spunbonded nonwoven fabric having a fiber diameter of 0.8 d, a draft ratio of 2900, nonwoven fabric-constituting polypropylene fiber MFR of 75 g/10 min and basis weight of 17 g/m$^2$ was obtained by using polypropylene having MFR of 70 g/10 min as raw material polypropylene, changing the resin temperature to 235° C., changing the upper cooling air flow velocity to 0.6 m/s, and changing the lower cooling air flow velocity to 2.1 m/s in Example 13.

Properties of the spunbonded nonwoven fabric were measured and evaluated in the same manner as in Example 1.

The results are set forth in Table 3.

Example 17

A spunbonded nonwoven fabric having a fiber diameter of 0.5 d, a draft ratio of 4600, nonwoven fabric-constituting polypropylene fiber MFR of 75 g/10 min and basis weight of 17 g/m$^2$ was obtained by using polypropylene having MFR of 70 g/10 min as raw material polypropylene, changing the resin temperature to 245° C., changing the upper cooling air flow velocity to 1.0 m/s, and changing the lower cooling air flow velocity to 3.5 m/s in Example 13.

Properties of the spunbonded nonwoven fabric were measured and evaluated in the same manner as in Example 1.

The results are set forth in Table 3.

Example 18

A spunbonded nonwoven fabric having a fiber diameter of 0.5 d, a draft ratio of 4600, nonwoven fabric-constituting polypropylene fiber MFR of 112 g/10 min and basis weight of 17 g/m$^2$ was obtained by using polypropylene having MFR of 100 g/10 min as raw material polypropylene, changing the resin temperature to 235° C., changing the upper cooling air flow velocity to 0.8 m/s, and changing the lower cooling air flow velocity to 3.2 m/s in Example 13.

Properties of the spunbonded nonwoven fabric were measured and evaluated in the same manner as in Example 1.

The results are set forth in Table 3.

Comparative Example 7

A spunbonded nonwoven fabric having a fiber diameter of 1.2 d, a draft ratio of 1900, nonwoven fabric-constituting polypropylene fiber MFR of 50 g/10 min and basis weight of 17 g/m$^2$ was obtained in the same manner as in Example 13, except that polypropylene having MFR of 40 g/10 min was used as raw material polypropylene and the resin temperature was changed to 235° C.

Properties of the spunbonded nonwoven fabric were measured and evaluated in the same manner as in Example 1.

The results are set forth in Table 3.

Comparative Example 8

A spunbonded nonwoven fabric having a fiber diameter of 1.8 d, a draft ratio of 1300, nonwoven fabric-constituting polypropylene fiber MFR of 70 g/10 min and basis weight of 17 g/m$^2$ was obtained in the same manner as in Example 13, except that the resin temperature was changed to 210° C., the upper cooling air flow velocity was changed to 0.3 m/s, and the lower cooling air flow velocity was changed to 1.1 m/s.

Properties of the spunbonded nonwoven fabric were measured and evaluated in the same manner as in Example 1.

The results are set forth in Table 3.

Comparative Example 9

A spunbonded nonwoven fabric having a fiber diameter of 1.2 d, a draft ratio of 1900, nonwoven fabric-constituting polypropylene fiber MFR of 70 g/10 min and basis weight of 17 g/m$^2$ was obtained in the same manner as in Example 13, except that an embossing roll (embossing pattern shape: circle, embossing pattern size: diameter 0.43 mm, pitch: 11.1 mm×2.1 mm, staggered arrangement) having an embossed area ratio of 6.3% was used.

Properties of the spunbonded nonwoven fabric were measured and evaluated in the same manner as in Example 1.

The results are set forth in Table 3.

Example 19

A spunbonded nonwoven fabric having a fiber diameter of 1.5 d, a draft ratio of 1500, nonwoven fabric-constituting polypropylene fiber MFR of 70 g/10 min and basis weight of 17 g/m was obtained by changing the stretching air flow rate to 2500 m$^3$/hr/m in Example 1.

Properties of the spunbonded nonwoven fabric were measured and evaluated in the same manner as in Example 1.

The results are set forth in Table 1.

Example 20

A spunbonded nonwoven fabric having a fiber diameter of 0.5 d, a draft ratio of 2100, nonwoven fabric-constituting polypropylene fiber MFR of 75 g/10 min and basis weight of 17 g/m$^2$ was obtained in the same manner as in Example 5, except that a nozzle diameter of 0.40 mm was used.

Properties of the spunbonded nonwoven fabric were measured and evaluated in the same manner as in Example 1.

The results are set forth in Table 1.

Example 21

A spunbonded nonwoven fabric having a fiber diameter of 0.5 d, a draft ratio of 3200, nonwoven fabric-constituting polypropylene fiber MFR of 75 g/10 min and basis weight of 17 g/m$^2$ was obtained in the same manner as in Example 5, except that a nozzle diameter of 0.50 mm was used.

Properties of the spunbonded nonwoven fabric were measured and evaluated in the same manner as in Example 1.

The results are set forth in Table 1.

Example 22

A spunbonded nonwoven fabric having a fiber diameter of 0.5 d, a draft ratio of 6300, nonwoven fabric-constituting polypropylene fiber MFR of 75 g/10 min and basis weight of 17 g/m$^2$ was obtained in the same manner as in Example 5, except that a nozzle diameter of 0.70 mm was used.

Properties of the spunbonded nonwoven fabric were measured and evaluated in the same manner as in Example 1.

The results are set forth in Table 1.

Example 23

A spunbonded nonwoven fabric having a fiber diameter of 0.5 d, a draft ratio of 8200, nonwoven fabric-constituting polypropylene fiber MFR of 75 g/10 min and basis weight of 17 g/m$^2$ was obtained in the same manner as in Example 5, except that a nozzle diameter of 0.80 mm was used.

Properties of the spunbonded nonwoven fabric were measured and evaluated in the same manner as in Example 1.

The results are set forth in Table 1.

Comparative Example 10

A spunbonded nonwoven fabric having a fiber diameter of 1.2 d, a draft ratio of 700, nonwoven fabric-constituting polypropylene fiber MFR of 50 g/10 min and basis weight of 17 g/m$^2$ was obtained in the same manner as in Example 1, except that a nozzle diameter of 0.35 mm was used, polypropylene having MFR of 40 g/10 min was used as raw material polypropylene, and the resin temperature was changed to 235° C.

Properties of the spunbonded nonwoven fabric were measured and evaluated in the same manner as in Example 1.

The results are set forth in Table 1.

Example 24

A spunbonded nonwoven fabric having a fiber diameter of 1.5 d, a draft ratio of 1500, nonwoven fabric-constituting polypropylene fiber MFR of 70 g/1.0 min and basis weight of 17 g/m$^2$ was obtained in the same manner as in Example 7, except that the stretching air gun pressure was changed to 3.5 kgf/cm$^2$.

Properties of the spunbonded nonwoven fabric were measured and evaluated in the same manner as in Example 1.

The results are set forth in Table 2.

Example 25

A spunbonded nonwoven fabric having a fiber diameter of 0.5 d, a draft ratio of 2100, nonwoven fabric-constituting polypropylene fiber MFR of 74 g/10 min and basis weight of 17 g/m$^2$ was obtained in the same manner as in Example 10, except that a nozzle diameter of 0.40 mm was used.

Properties of the spunbonded nonwoven fabric were measured and evaluated in the same manner as in Example 1.

The results are set forth in Table 2.

Example 26

A spunbonded nonwoven fabric having a fiber diameter of 0.5 d, a draft ratio of 3200, nonwoven fabric-constituting polypropylene fiber MFR of 74 g/10 min and basis weight of 17 g/m$^2$ was obtained in the same manner as in Example 10, except that a nozzle diameter of 0.50 mm was used.

Properties of the spunbonded nonwoven fabric were measured and evaluated in the same manner as in Example 1.

The results are set forth in Table 2.

Example 27

A spunbonded nonwoven fabric having a fiber diameter of 0.5 d, a draft ratio of 6300, nonwoven fabric-constituting polypropylene fiber MFR of 74 g/10 min and basis weight of 17 g/m$^2$ was obtained in the same manner as in Example 10, except that a nozzle diameter of 0.70 mm was used.

Properties of the spunbonded nonwoven fabric were measured and evaluated in the same manner as in Example 1.

The results are set forth in Table 2.

Example 28

A spunbonded nonwoven fabric having a fiber diameter of 0.5 d, a draft ratio of 8200, nonwoven fabric-constituting polypropylene fiber MFR of 74 g/10 min and basis weight of 17 g/m$^2$ was obtained in the same manner as in Example 10, except that a nozzle diameter of 0.80 mm was used.

Properties of the spunbonded nonwoven fabric were measured and evaluated in the same manner as in Example 1.

The results are set forth in Table 2.

Comparative Example 11

A spunbonded nonwoven fabric having a fiber diameter of 1.2 d, a draft ratio of 700, nonwoven fabric-constituting polypropylene fiber MFR of 50 g/10 min and basis weight of 17 g/m$^2$ was obtained in the same manner as in Example 7, except that a nozzle diameter of 0.35 mm was used, polypropylene having MFR of 40 g/10 min was used as raw material polypropylene, and the resin temperature was changed to 235° C.

Properties of the spunbonded nonwoven fabric were measured and evaluated in the same manner as in Example 1.

The results are set forth in Table 2.

Example 29

A spunbonded nonwoven fabric having a fiber diameter of 1.5 d, a draft ratio of 1500, nonwoven fabric-constituting polypropylene fiber MFR of 70 g/10 min and basis weight of 17 g/m$^2$ was obtained in the same manner as in Example 13, except that the upper cooling air flow velocity was changed to 0.3 m/s, and the lower cooling air flow velocity was changed to 1.1 m/s.

Properties of the spunbonded nonwoven fabric were measured and evaluated in the same manner as in Example 1.

The results are set forth in Table 3.

Example 30

A spunbonded nonwoven fabric having a fiber diameter of 0.5 d, a draft ratio of 2100, nonwoven fabric-constituting polypropylene fiber MFR of 75 g/10 min and basis weight of 17 g/m$^2$ was obtained in the same manner as in Example 17, except that a nozzle diameter of 0.40 mm was used.

Properties of the spunbonded nonwoven fabric were measured and evaluated in the same manner as in Example 1.

The results are set forth in Table 3.

Example 31

A spunbonded nonwoven fabric having a fiber diameter of 0.5 d, a draft ratio of 3200, nonwoven fabric-constituting polypropylene fiber MFR of 75 g/10 min and basis weight of 17 g/m$^2$ was obtained in the same manner as in Example 17, except that a nozzle diameter of 0.50 mm was used.

Properties of the spunbonded nonwoven fabric were measured and evaluated in the same manner as in Example 1.

The results are set forth in Table 3.

Example 32

A spunbonded nonwoven fabric having a fiber diameter of 0.5 d, a draft ratio of 6300, nonwoven fabric-constituting polypropylene fiber MFR of 75 g/10 min and basis weight of 17 g/m$^2$ was obtained in the same manner as in Example 17, except that a nozzle diameter of 0.70 mm was used.

Properties of the spunbonded nonwoven fabric were measured and evaluated in the same manner as in Example 1.

The results are set forth in Table 3.

Example 33

A spunbonded nonwoven fabric having a fiber diameter of 0.5 d, a draft ratio of 8200, nonwoven fabric-constituting polypropylene fiber MFR of 75 g/10 min and basis weight of 17 g/m$^2$ was obtained in the same manner as in Example 17, except that a nozzle diameter of 0.80 mm was used.

Properties of the spunbonded nonwoven fabric were measured and evaluated in the same manner as in Example 1.

The results are set forth in Table 3.

Comparative Example 12

A spunbonded nonwoven fabric having a fiber diameter of 1.2 d, a draft ratio of 700, nonwoven fabric-constituting polypropylene fiber MFR of 50 g/10 min and basis weight of 17 g/m$^2$ was obtained in the same manner as in Example 13, except that a nozzle diameter of 0.35 mm was used, polypropylene having MFR of 40 g/10 min was used as raw material polypropylene, and the resin temperature was changed to 235° C.

Properties of the spunbonded nonwoven fabric were measured and evaluated in the same manner as in Example 1.

The results are set forth in Table 3.

TABLE 1

| Process | Ex. 1 (1) | Ex. 2 (1) | Ex. 3 (1) | Ex. 4 (1) | Ex. 5 (1) | Ex. 6 (1) | Ex. 19 (1) | Ex. 20 (1) |
|---|---|---|---|---|---|---|---|---|
| Nonwoven fabric MFR [g/10 min (230° C.)] | 70 | 70 | 130 | 75 | 75 | 110 | 70 | 75 |
| Raw material MFR [g/10 min (230° C.)] | 65 | 65 | 120 | 70 | 70 | 100 | 65 | 70 |
| Nozzle diameter [mm] | 0.60 | 0.60 | 0.60 | 0.60 | 0.60 | 0.60 | 0.60 | 0.40 |
| Embossed area ratio [%] | 21 | 21 | 21 | 21 | 21 | 21 | 21 | 21 |

TABLE 1-continued

| | | | | | | | | |
|---|---|---|---|---|---|---|---|---|
| Fineness [d] | 1.2 | 1.2 | 1.2 | 0.8 | 0.5 | 0.5 | 1.5 | 0.5 |
| Draft ratio [-] | 1900 | 1900 | 1900 | 2900 | 4600 | 4600 | 1500 | 2100 |
| Basis weight [g/m$^2$] | 17 | 15 | 17 | 17 | 17 | 17 | 17 | 17 |
| Fluffing resistance [point(s)] | 1.0 | 1.0 | 1.0 | 1.0 | 1.0 | 1.0 | 1.0 | 1.0 |
| Softness index [mm/20 mm/(g/m$^2$)] | 2.0 | 1.9 | 2.0 | 1.8 | 1.8 | 1.8 | 2.0 | 1.8 |
| Tensile strength index [N/25 mm/(g/m$^2$)] | 1.0 | 1.0 | 0.9 | 1.2 | 1.2 | 1.0 | 0.9 | 1.0 |
| Productivity [-] | AA | AA | AA | AA | AA | AA | AA | AA |

| Process | Ex. 21 (1) | Ex. 22 (1) | Ex. 23 (1) | Comp. Ex. 1 (1) | Comp. Ex. 2 (1) | Comp. Ex. 3 (1) | Comp. Ex. 10 (1) |
|---|---|---|---|---|---|---|---|
| Nonwoven fabric MFR [g/10 min (230° C.)] | 75 | 75 | 75 | 50 | 70 | 70 | 50 |
| Raw material MFR [g/10 min (230° C.)] | 70 | 70 | 70 | 40 | 65 | 65 | 40 |
| Nozzle diameter [mm] | 0.50 | 0.70 | 0.80 | 0.60 | 0.60 | 0.60 | 0.35 |
| Embossed area ratio [%] | 21 | 21 | 21 | 21 | 21 | 6.3 | 21 |
| Fineness [d] | 0.5 | 0.5 | 0.5 | 1.2 | 1.8 | 1.2 | 1.2 |
| Draft ratio [-] | 3200 | 6300 | 8200 | 1900 | 1300 | 1900 | 700 |
| Basis weight [g/m$^2$] | 17 | 17 | 17 | 17 | 17 | 17 | 17 |
| Fluffing resistance [point(s)] | 1.0 | 1.0 | 1.0 | 1.0 | 1.0 | 2.6 | 1.0 |
| Softness index [mm/20 mm/(g/m$^2$)] | 1.8 | 1.8 | 1.8 | 2.0 | 2.7 | 2.0 | 2.0 |
| Tensile strength index [N/25 mm/(g/m$^2$)] | 1.1 | 1.2 | 1.3 | 0.9 | 0.7 | 0.7 | 0.8 |
| Productivity [-] | AA | AA | AA | BB | AA | AA | BB |

TABLE 2

| Process | Ex. 7 (2) | Ex. 8 (2) | Ex. 9 (2) | Ex. 10 (2) | Ex. 11 (2) | Ex. 12 (2) | Ex. 24 (2) | Ex. 25 (2) |
|---|---|---|---|---|---|---|---|---|
| Nonwoven fabric MFR [g/10 min (230° C.)] | 75 | 75 | 130 | 74 | 74 | 116 | 70 | 74 |
| Raw material MFR [g/10 min (230° C.)] | 65 | 65 | 120 | 70 | 70 | 100 | 65 | 70 |
| Nozzle diameter [mm] | 0.6 | 0.6 | 0.6 | 0.6 | 0.6 | 0.6 | 0.60 | 0.40 |
| Embossed area ratio [%] | 7.0 | 7.0 | 7.0 | 7.0 | 7.0 | 7.0 | 7.0 | 7.0 |
| Fineness [d] | 1.2 | 1.2 | 1.2 | 0.8 | 0.5 | 0.5 | 1.5 | 0.5 |
| Draft ratio [-] | 1900 | 1900 | 1900 | 2900 | 4600 | 4600 | 1500 | 2100 |
| Basis weight [g/m$^2$] | 17 | 15 | 17 | 17 | 17 | 17 | 17 | 17 |
| Fluffing resistance [point(s)] | 1.0 | 1.0 | 1.0 | 1.0 | 1.0 | 1.0 | 1.0 | 1.0 |
| Softness index [mm/20 mm/(g/m$^2$)] | 2.0 | 1.9 | 2.0 | 1.8 | 1.8 | 1.8 | 2.0 | 1.8 |
| Tensile strength index [N/25 mm/(g/m$^2$)] | 1.0 | 1.1 | 0.9 | 1.2 | 1.2 | 1.0 | 0.9 | 1.0 |
| Productivity [-] | AA | AA | AA | AA | AA | AA | AA | AA |

| Process | Ex. 26 (2) | Ex. 27 (2) | Ex. 28 (2) | Comp. Ex. 4 (2) | Comp. Ex. 5 (2) | Comp. Ex. 6 (2) | Comp. Ex. 11 (2) |
|---|---|---|---|---|---|---|---|
| Nonwoven fabric MFR [g/10 min (230° C.)] | 74 | 74 | 74 | 51 | 70 | 70 | 50 |
| Raw material MFR [g/10 min (230° C.)] | 70 | 70 | 70 | 40 | 65 | 65 | 40 |
| Nozzle diameter [mm] | 0.50 | 0.70 | 0.80 | 0.60 | 0.60 | 0.60 | 0.35 |
| Embossed area ratio [%] | 7.0 | 7.0 | 7.0 | 7 | 7 | 6.3 | 7.0 |
| Fineness [d] | 0.5 | 0.5 | 0.5 | 1.2 | 1.8 | 1.2 | 1.2 |
| Draft ratio [-] | 3200 | 6300 | 8200 | 1900 | 1300 | 1900 | 700 |
| Basis weight [g/m$^2$] | 17 | 17 | 17 | 17 | 17 | 17 | 17 |
| Fluffing resistance [point(s)] | 1.0 | 1.0 | 1.0 | 1.0 | 1.0 | 2.6 | 1.0 |
| Softness index [mm/20 mm/(g/m$^2$)] | 1.8 | 1.8 | 1.8 | 2.0 | 2.7 | 2.0 | 2.0 |
| Tensile strength index [N/25 mm/(g/m$^2$)] | 1.1 | 1.2 | 1.3 | 0.9 | 0.7 | 0.7 | 0.8 |
| Productivity [-] | AA | AA | AA | BB | AA | AA | BB |

TABLE 3

| Process | Ex. 13 (3) | Ex. 14 (3) | Ex. 15 (3) | Ex. 16 (3) | Ex. 17 (3) | Ex. 18 (3) | Ex. 29 (3) | Ex. 30 (3) |
|---|---|---|---|---|---|---|---|---|
| Nonwoven fabric MFR [g/10 min (230° C.] | 70 | 70 | 130 | 75 | 75 | 112 | 70 | 75 |
| Raw material MFR [g/10 min (230° C.)] | 65 | 65 | 120 | 70 | 70 | 100 | 65 | 70 |
| Nozzle diameter [mm] | 0.6 | 0.6 | 0.6 | 0.6 | 0.6 | 0.6 | 0.60 | 0.40 |
| Embossed area ratio [%] | 18 | 18 | 18 | 18 | 18 | 18 | 18 | 18 |
| Fineness [d] | 1.2 | 1.2 | 1.2 | 0.8 | 0.5 | 0.5 | 1.5 | 0.5 |
| Draft ratio [-] | 1900 | 1900 | 1900 | 2900 | 4600 | 4600 | 1500 | 2100 |
| Basis weight [g/m$^2$] | 17 | 15 | 17 | 17 | 17 | 17 | 17 | 17 |
| Fluffing resistance [point(s)] | 1.0 | 1.0 | 1.0 | 1.0 | 1.0 | 1.0 | 1.0 | 1.0 |
| Softness index [mm/20 mm/(g/m$^2$)] | 2.0 | 1.9 | 2.0 | 1.8 | 1.8 | 1.8 | 2.0 | 1.8 |
| Tensile strength index [N/25 mm/(g/m$^2$)] | 1.0 | 1.1 | 0.9 | 1.2 | 1.2 | 1.0 | 0.9 | 1.0 |
| Productivity [-] | AA | AA | AA | AA | AA | AA | AA | AA |

| Process | Ex. 31 (3) | Ex. 32 (3) | Ex. 33 (3) | Comp. Ex. 7 (3) | Comp. Ex. 8 (3) | Comp. Ex. 9 (3) | Comp. Ex. 12 (3) |
|---|---|---|---|---|---|---|---|
| Nonwoven fabric MFR [g/10 min (230° C.)] | 75 | 75 | 75 | 50 | 70 | 70 | 50 |
| Raw material MFR [g/10 min (230° C.)] | 70 | 70 | 70 | 40 | 65 | 65 | 40 |
| Nozzle diameter [mm] | 0.50 | 0.70 | 0.80 | 0.60 | 0.60 | 0.60 | 0.35 |
| Embossed area ratio [%] | 18 | 18 | 18 | 18 | 18 | 6.3 | 18 |
| Fineness [d] | 0.5 | 0.5 | 0.5 | 1.2 | 1.8 | 1.2 | 1.2 |
| Draft ratio [-] | 3200 | 6300 | 8200 | 1900 | 1300 | 1900 | 700 |
| Basis weight [g/m$^2$] | 17 | 17 | 17 | 17 | 17 | 17 | 17 |
| Fluffing resistance [point(s)] | 1.0 | 1.0 | 1.0 | 1.0 | 1.0 | 2.6 | 1.0 |
| Softness index [mm/20 mm/(g/m$^2$)] | 1.8 | 1.8 | 1.8 | 2.0 | 2.7 | 2.0 | 2.0 |
| Tensile strength index [N/25 mm/(g/m$^2$)] | 1.1 | 1.2 | 1.3 | 0.9 | 0.7 | 0.7 | 0.8 |
| Productivity [-] | AA | AA | AA | BB | AA | AA | BB |

The invention claimed is:

1. A spunbonded nonwoven fabric which is formed from fibers comprising a propylene-based polymer and has MFR of 65 to 150 g/10 min which is a value measured after forming the spunbonded nonwoven fabric and a fineness of 0.01 to 1.5 deniers, wherein the basis weight is in the range of 5 to 40 g/m$^2$ and the embossed area ratio is in the range of 6.5 to 25%, and wherein the fibers comprising a propylene-based polymer are formed in a draft ratio of not less than 1500.

2. The spunbonded nonwoven fabric as claimed in claim 1, which has a fluffing resistance of 1.0 to 2.0 points, a softness index, as expressed in terms of bending resistance/basis weight, of not more than 2.2 mm/20 mm/(g/m$^2$) and a tensile strength index, as expressed in terms of tensile strength/basis weight, of not less than 0.9 N/25 mm/(g/m$^2$).

3. The spunbonded nonwoven fabric as claimed in claim 1, which is obtained by the production using a propylene-based polymer having MFR of 60 to 150 g/10 min which is a value measured before producing the spunbonded nonwoven fabric.

4. The spunbonded nonwoven fabric as claimed in claim 2, which is obtained by the production using a propylene-based polymer having MFR of 60 to 150 g/10 min which is a value measured before producing the spunbonded nonwoven fabric.

* * * * *